United States Patent [19]

Rothman et al.

[11] 4,038,806

[45] Aug. 2, 1977

[54] COIN PACKAGING MACHINE

[75] Inventors: Bernard Rothman, Paris; Julien G. Fiks, Le Vesinet, both of France; Friedrich C. Bang, Bad-Wuerttemberg, Germany

[73] Assignee: Werner F. Westermann, Falls Church, Va.

[21] Appl. No.: 631,201

[22] Filed: Nov. 12, 1975

[51] Int. Cl.[2] ..... B65B 11/04

[52] U.S. Cl. ..... 53/32; 53/212

[58] Field of Search ..... 53/211, 212, 32; 133/1 A, 8 A

[56] References Cited

U.S. PATENT DOCUMENTS

| | | | |
|---|---|---|---|
| 751,246 | 2/1904 | Batdorf | 53/212 X |
| 2,635,402 | 4/1953 | Jorgensen | 53/212 X |
| 3,432,983 | 3/1969 | Picollo | 53/212 X |
| 3,798,873 | 3/1974 | Frahm | 53/212 |
| 3,821,917 | 7/1974 | Hatanaka | 53/212 X |
| 3,905,176 | 9/1975 | Ushio | 53/212 |

FOREIGN PATENT DOCUMENTS

| | | | |
|---|---|---|---|
| 817,798 | 8/1959 | United Kingdom | 53/211 |

*Primary Examiner*—Othell M. Simpson
*Assistant Examiner*—John Sipos
*Attorney, Agent, or Firm*—Diller, Brown, Ramik & Wight

[57] ABSTRACT

A device for stacking and packaging coins. The coins are inserted into the top of a vertically oriented cylindrical housing that can be closed at its lower end by a swivel-mounted closure. The interior diameter of the housing corresponds to the diameter of the coins to be processed. The stacked coins are rotated around their axes by several guide rollers set parallel to the axis of the stack and at least as high as the stack. They are wrapped in paper fed into the machine tangentially to the stack and then passed through a cutting device. Two edging hooks, one located at the top, the other at the bottom of the stack fold the excess paper over. Timing of the different stages is automatically adjusted.

11 Claims, 8 Drawing Figures

COIN PACKAGING MACHINE

BACKGROUND OF THE INVENTION

In known wrapping machines of a similar type the cylindrical housing receiving the counted coins consists of two cylindrical half-shells equipped at the bottom with a sleeve. During the loading process the two half-shells are connected, having an interior diameter nearly equal to that of the coins to be processed. As soon as a predetermined number of coins has been stacked, a swiveled stop slides over the top of the stack clamping the stack securely to a bottom stop. Then the two half-shells are opened up and the stack is transferred to a wrapping device.

The wrapping device consists of three offset guide rollers, their axes parallel to that of the stack. One of these rollers can be turned sideways to allow insertion of the stacked coins. Then the rollers are driven toward the stack and rotated while paper tape serving as wrapper is fed to the stack. Compacting the stack is effected by pressure between the bottom stop and an arm pressing down from the top. The rotation of the rollers is transferred to the stack and the paper wrapped around it. The track along which the paper moves is directed over a toothed cutting knife. When a predetermined and adjustable length of paper has been wrapped around the stack, the paperflow is automatically stopped, producing sufficient tension for tearing the paper off along the extended knife.

The width of the paperstrip is calculated to allow for a certain excess of paper both at the top and the bottom of the stack. This excess is folded over by edging hooks activated by the stoppage of the paperflow while the stack continues rotating. This operation prevents the coins from dropping out of the wrapper. The edging operation can be limited in advance by installing stops that are adjusted to the height of the stack whereby the simultaneous release of the completed, wrapped stack can be effected. This is done by swinging outward at least one of the guide rollers travelling on the lower swiveling stop.

Resumption of input and stacking in the cylindrical housing can begin during the final stage of wrapping. The known wrapping machine is characterized by a high output at a fast rate of speed. However, due to the separation of the stacking and the packaging units, which call for a transfer device, the known machine involves a major effort in engineering and production. As a result, the equipment is so expensive to build that only relatively large financial institutions find it profitable to use it.

In the change-over to coins of different sizes, the axially split housing must be exchanged for one that corresponds in its diameter to that of the new stack. Guide rollers and edgers must also be adjusted to it. Since in most instances the height of the stack changes too, the position of the holding arm which presses down upon the stack during the transport from the stacking area to the packaging point, must be adapted accordingly. For that reason a suitably trained operator is needed to operate the conventional equipment.

SUMMARY OF THE INVENTION

Starting from the above premises, the object of this invention is to build a device for stacking and wrapping coins that is characterized by a lesser effort in engineering and production as well as a correspondingly lower manufacturing cost. Furthermore, the operation and servicing, in particular the change-over to different coins, is made easier.

These objectives are successfully accomplished in the present invention. Starting out from a device as described above, the wrapping is performed inside the housing. To do that, the housing is equipped with at least three longitudinal slots at symmetrical intervals, in length at least equal to the maximum height of the stacked and counted coins.

Into each slot one of the guide rollers can be introduced parallel with the axis of the stack and pressed by spring action against the roll, and the packing paper is fed to the stack either through one of these mentioned slots or through a separate longitudinal slot.

Through the advanced design according to the new invention the stacking and wrapping phases are combined in one single unit. Thereby the manufacturing process for this equipment is greatly simplified, since there is no longer a need for transferring the stacks between two operational stages. The operation and maintenance of the machine is simplified, and the adjustments connected with changing over to different coins has become limited to a few elements.

The guide rollers efficiently slide inward while the coins are fed into the machine, protruding partly inside the housing. Through constant rotation of at least one of the rollers, which rotation is transmitted to the other rollers by the rotation of the coins, a firm stacking of the fed-in coins is effected.

The paper is supplied in the conventional manner by a roll and guided across a cutting knife whose edge lies lateral to the paper track. The paper is inserted between the coins and the wall of the housing through one of the slots and is held tight by the guide rollers, thereby wrapping itself around the stack. Subsequently, edging hooks of a conventional type start edging the protruding rims of the paper shells. When edging is completed, the guide rollers, activated by a suitable signal, are automatically swung outward a small distance, allowing the completed stack to slide out of the housing. The interior diameter of the housing allows for sufficient play for the stack to drop out of the housing solely by its own weight.

To further simplify the change-over of the machine to coins of different sizes it was found advantageous to equip the housing with a radially protruding stop which limits by contact the inward motion of the guide rollers, the stop being of the same size as the interior diameter of the housing. Since the interior diameter of housing corresponds to the size of the coins, the inward motion of the rollers is thereby automatically adapted to the diameter of the coins to be processed. In this way, regardless of the size of the coins, the rollers are swung inward through the slots in the housing to the correct distance. The operator merely needs to insert a housing that is marked identifying the respective type of coins, thereby automatically controlling the correct inward motion of the guide rollers.

To simplify the edging process it is practical that the two edging hooks can be driven radially into the interior of the housing through suitable slots, both underneath and on top of the stacked coins and that they can slide axially of the stack, the protruding stop controlling the radial inward motion. Thereby the position of the edging hooks is automatically adapted to the diameter of the coins.

Several alternatives offer themselves to the engineer for the control of the motion of the guide rollers. They may be designed to slide either on rails, or in grooves, both converging radially, or slanting at an angle, from the outside toward the longitudinal slots in the housing. It is, however, eminently practical to lead the guide rollers toward the longitudinal slots in the housing by a swing-motion. To accomplish this, the freely turning guide rollers are suspended between upper and lower swiveling bars of a frame that rests on a steering plate which, engaged by guide pins, can turn in a curved path relative to the frame. The purpose of this steering plate is to cause the guide rollers to swivel outward whenever a completed stack of coins is released by the machine. Besides that, by further turning the guide plate, the rollers can be swung completely out of the housing, thereby enabling the operator to change the housing altogether when changing over to a different size of coin.

The edging hooks can be moved radially, each resting on a slide which in turn runs on a rail and can be moved vertically. The rail is connected to the frame by hoops that can swivel freely, and the hoops are guided by a guide pin to move in an additional curved guide on the steering plate. By this arrangement the two edging hooks are automatically retracted with the turn of the guide plate so that the packaged coin stack can slide intact out of the housing, whereupon the housing itself can be easily replaced with another one.

Further advantages are that the edging hooks are held in a retracted position by a spring located between the two slides, the force of which exceeds the sum of the forces acting on the hooks. A draw cord attached to each respective lever of the two edging hooks is used to move the hooks toward the protruding edges of the wrapper, running at first horizontally in a direction away from the hooks, subsequently, deflected vertically into the space between them; then it is taken up by the two rollers and again horizontally connected to a pulley. By means of this arrangement the two edging hooks are first moved radially into the interior of the housing by a single tug in a forward direction since the force of the springs acting on the edging hooks is less than that of the string acting on the two slides that move vertically. When the hooks have reached their foremost position, continued pull on the string will move the two slides toward each other. Thereby the edging hooks make contact with the protruding edge of the paper and crimp it in the desired manner. The vertical movement between the two slides depends on the height of the stack and also on the kind of coin processed. It is, therefore, especially practical to make allowance in this vertical adjustment and provide stops for limiting this movement at the housing, thereby making tedious fine adjustments unnecessary when changing over to other coins. But, it is also possible to get by without the mentioned stops, and let the pulley be driven by a sliding coupling which automatically releases the tug on the pulley as soon as a predetermined, adjustable counterforce has been reached. The two slides are then pushed outward by the spring located between them, and the edging hooks are pushed back by the spring between them.

The sliding arms of the guide rollers and the hoops of the edging hooks are under spring tension directed inwardly, while the outward turns result from the turn of the guide plate. To drive the latter, an electromagnet is used which at the completion of the edging process activates the guide plate to turn, thereby causes the swing arms as well as the hoops to swing outwardly. They are guided by pins that run along the curved guides.

Finally, it has been proven practical to equip two of the three guide rollers with a drive mechanism, by connecting them with belts over a pulley journalled about the axis of the swing bar, and both pulleys, again by separate belts, to a drive motor mounted on the assembly. In this manner, the motion of the guide rollers does not affect the tension in the drive belts.

Further advantages and characteristics of the present invention will be apparent from the description of a prototype shown in the accompanying drawings.

DESCRIPTION OF A PREFERRED EMBODIMENT

Figure 1:
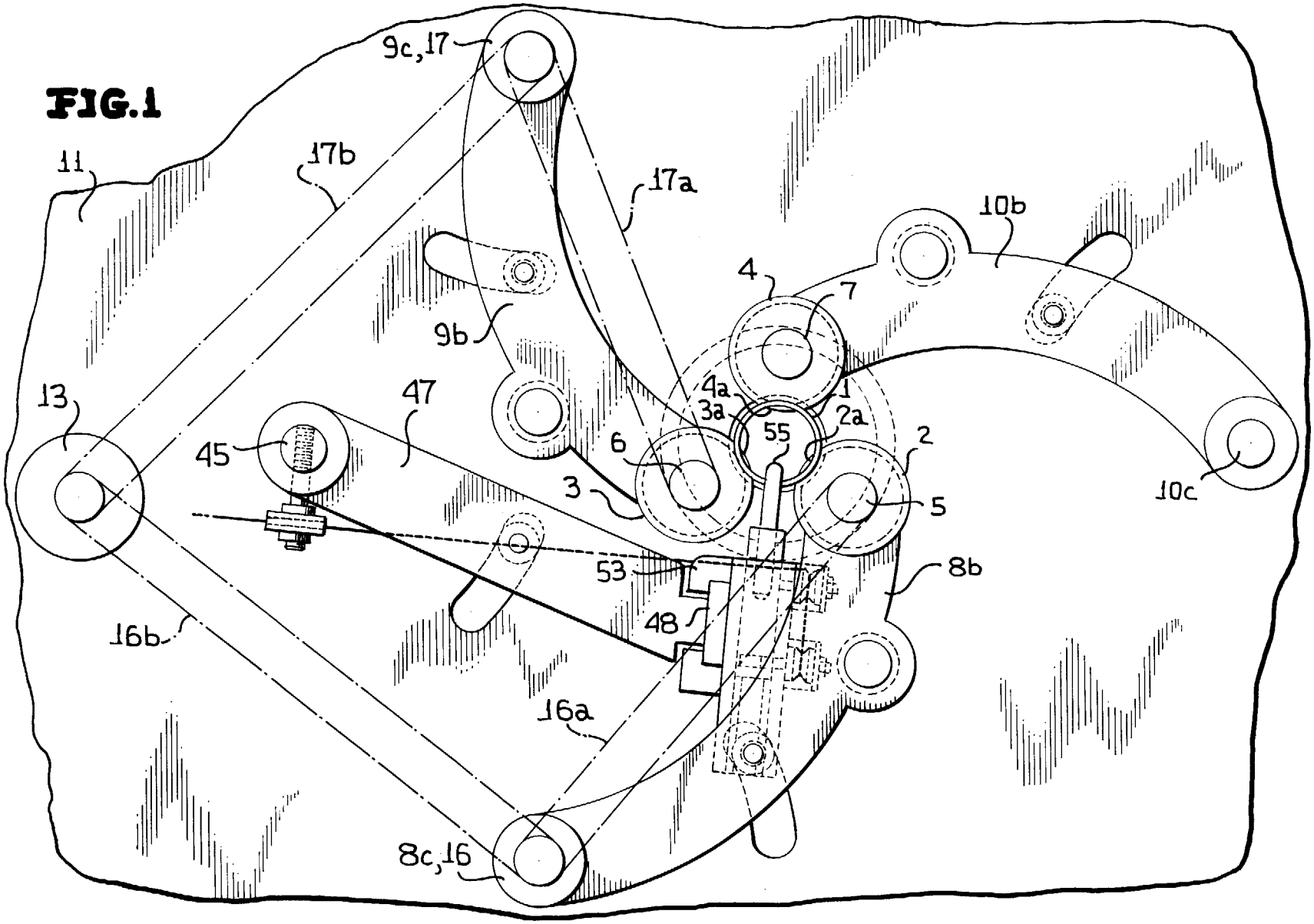
FIG. 1 is a top view of the packager with the cover plate removed.

The operations of stacking and wrapping the coins in accordance with the present invention take place in the housing itself, identified in FIG. 1 by numeral 1. Three guide rollers, 2, 3, 4, are arranged in radial symmetry about the center of the housing and partially intrude with arcs *2a, 3a, 4a*, respectively, in the interior of the housing through longitudinal slots that are not shown in FIG. 1. The diameter of the guide rollers is approximately the same as that of the standard-size coins, while their length somewhat exceeds the maximum height of the stacks, both at the top and the bottom. The measurements of the slots in the housing are such that rollers, 2, 3, 4, can move partially into the housing 1.

Figure 2:
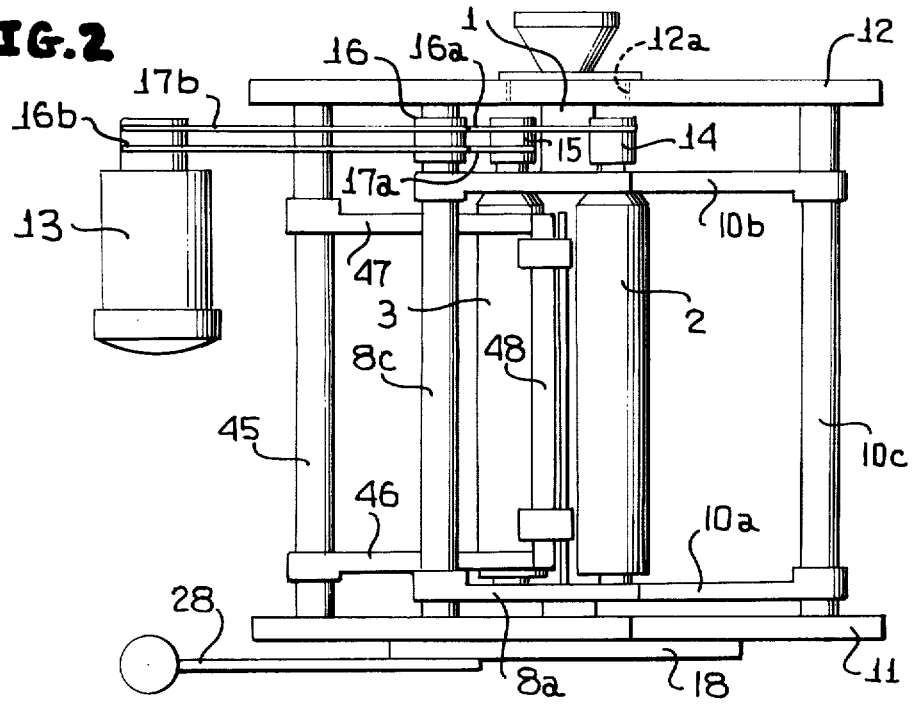
FIG. 2 is a side view of the packager, on a reduced scale, minus the output ramp for finished rolls.

The lateral projection of the rollers is shown in FIG. 2. Since the rollers are placed around housing 1 at about 102° intervals, roller 4, being located at the rear, cannot be seen.

Figure 3:
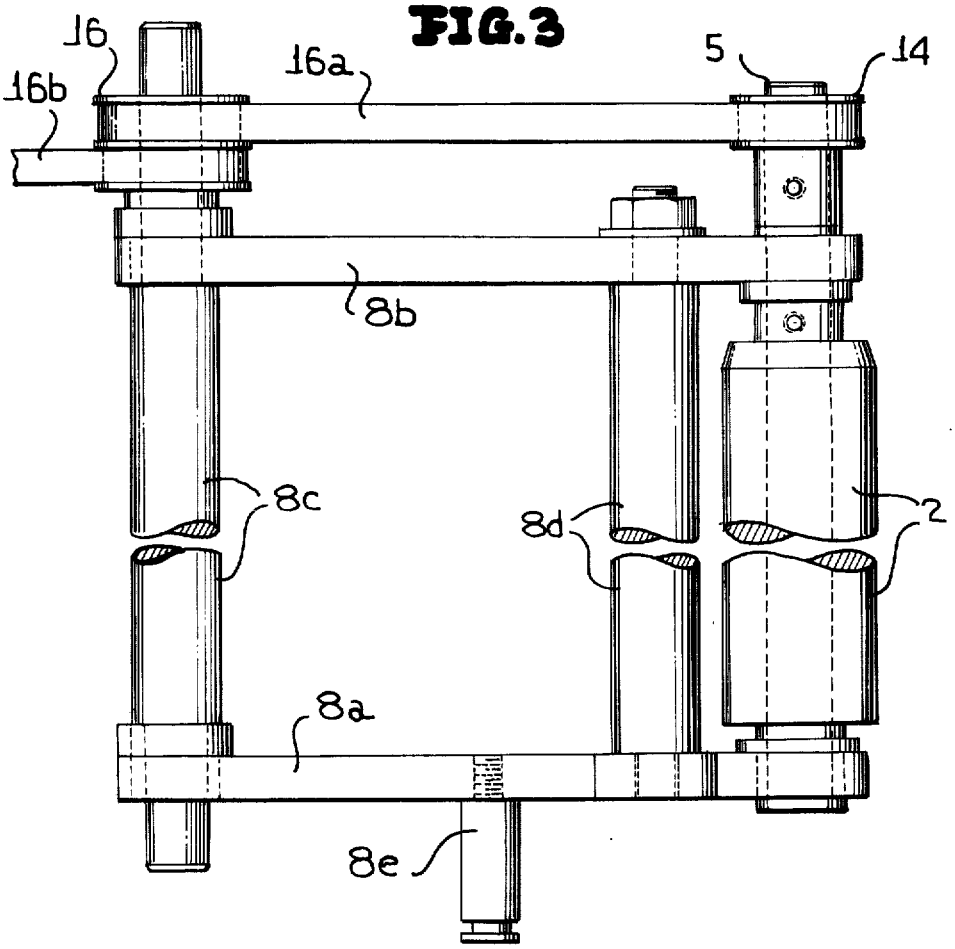
FIG. 3 is a side view of a guide roller unit.

The mounting of the guide rollers is shown in FIG. 3 by the example of roller 2. Each roller is mounted on an axle, 5, 6, 7, which, in turn, extends between and is journalled in two sliding arms, *8a, 8b; 9a, 9b; 10a, 10b*, allowing the rollers to rotate. The two arms *8a* and *8b*, *9a* and *9b*, *10a* and *10b*, respectively, are connected at their other ends by swivel axles *8c, 9c, 10c*, in such manner that the levers can be rotated relative to their respective axles. To increase stability the levers are interconnected by connecting rods *8d, 9d, 10d*.

The swivel axles *8c, 9c*, and *10c* extend at their ends outwardly of the arms into a base plate 11 and a cover plate 12, as clearly shown in FIG. 2. These plates are fixed parts of the machine frame. Under this arrangement, parts *8a, 8b, 8d; 9a, 9d; 10a, 10b, 10d*, respectively, each, form a swivel frame that can be swung toward the housing 1 around axles *8c, 9c, 10c*, in such manner that the rollers 2, 3, 4, can be swung toward the housing 1 and be made to partially penetrate with sectors 2a, 3a, 4a through the axial slots in the housing.

The two guide rollers 2 and 3 are rotated by an electric motor 13 which is firmly attached to the frame, while roller 4 rotates freely. To accomplish this, protruding axles 5, 6 of rollers 2 and 3 are fixed at their tops to pulleys 14, 15. Also, the upper end of swivel axles 8c, 9c each holds a twin pulley 16, 17 (FIG. 3), which can be turned on the swivel axle. Twin pulley 16 is connected by a transmission belt 16a to pulley 14; by another belt 16b, to the motor 13. Likewise, twin pulley 17, not seen in FIG. 2, is connected by belt 17a with pulley 15, and by belt 17b, with motor 13. The path of the belts is clearly indicated in FIG. 1 and shows that the swivel motion of the rollers does not affect the tension of the belts.

Figure 4:
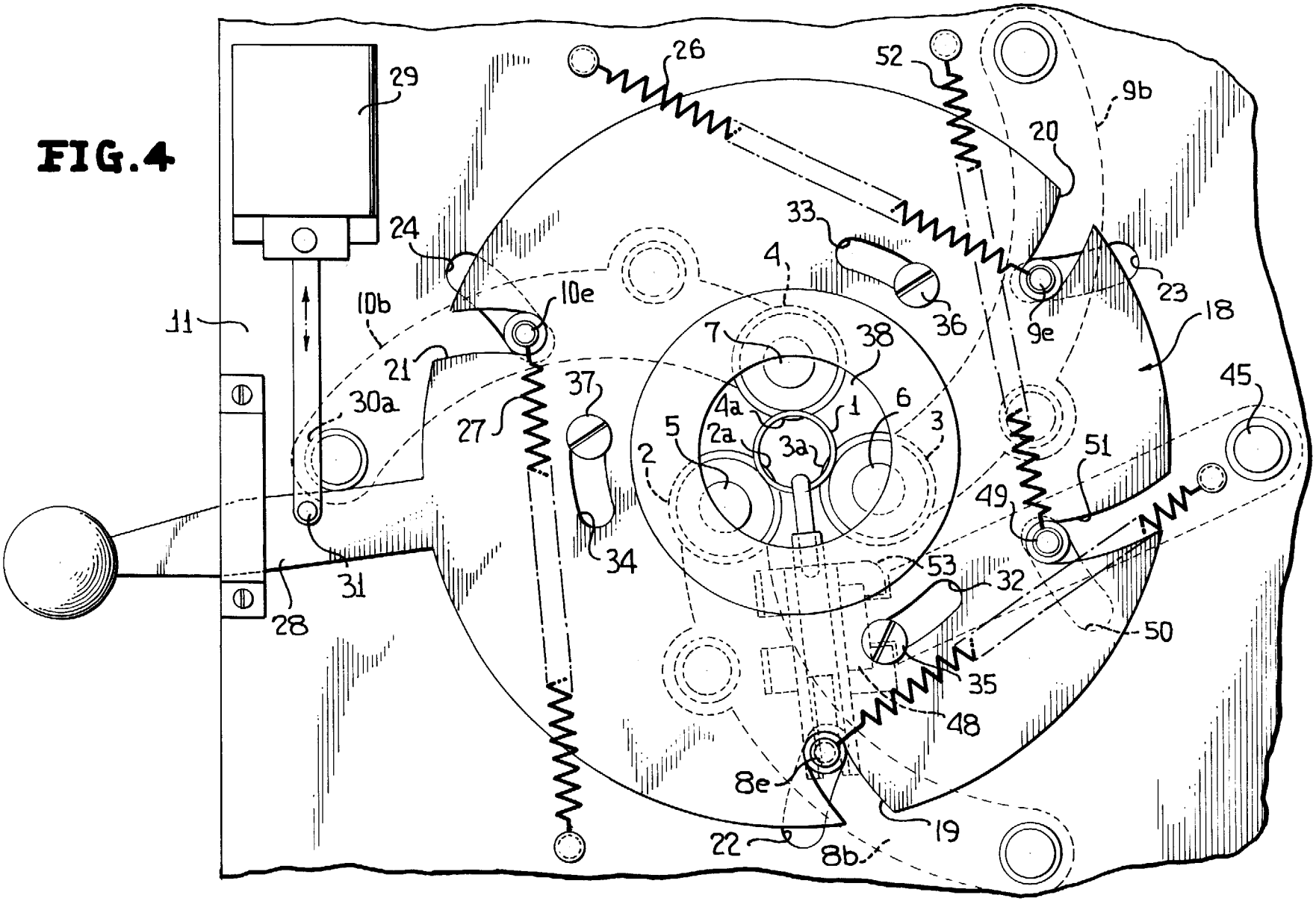
FIG. 4 is a bottom view of the packager minus the output ramp for rolls.

The bottom projection of the packaging machine shown in FIG. 4 with the roll receptacle taken off, shows guide plate 18, placed coaxially to housing 1. As shown in FIG. 2, it lies underneath base plate 11 and can be turned freely. This guide plate is equipped with three slots 19, 20, 21, from the periphery inwardly, which act as guides for pegs 8e, 9e, 10e, which, in turn, are carried by the arms 8a, 9a, 10a. When correlating FIG. 1 with FIG. 4, it is to be noted that the two views form mirror images representing opposite aspects. Slots 22, 23, 24, in base plate 11, permit penetration of guide pegs 8e, 9e, 10e, allowing them to freely swivel outwardly, propelling rollers 2, 3, 4.

FIG. 4 shows further that guide rollers 2, 3, 4 are held in tension by pull springs 25, 26, 27, connected to pegs 8e, 9e, 10e, pulling them inward, and thereby pressing with a predetermined force on coins stacked in the housing 1.

Through lever arm 28 the guide plate 18 is coupled to an electromagnet 29, causing the plate to turn in a direction opposite to the pull of the springs. Thereby guide rollers 2, 3, 4 are radially diverted outwardly, releasing the stack of coins in housing 1. Connection between lever arm 28 and the electromagnet 29 is established through a slot 30a in rod 30 which is traversed by peg 31 mounted on lever arm 28. The position of the slot is such that the upward motion of rod 30 propels lever 28, thereby causing guide rollers 2, 3, 4, to move radially in spring-supported motion, and whereby guide plate 18 can be manually turned without displacing rod 30.

The position of guide plate 18 on base plate 11 is maintained, as shown in FIG. 4, by slots 32, 33, 34, in the plate 18. These slots are traversed by screws 35, 36, 37, attached to base plate 11 and secure the plate axially, but at the same time leaving, circumferentially, sufficient play for the swivel motion described above.

Opening 38 centrally through base plate 11 and guide plate 18 serves to allow the completed coin packages to drop out of the machine. The diameter of this opening is such that coins of the largest diameter used can pass through it into receptacle 39 shown in FIG. 5. During the process of stacking and wrapping, a stop bolt 40 swings into opening 38 for the purpose of holding up the stack, yet permitting it to be rotated by rollers 2, 3, 4. This retaining bolt 40 is guided by a parallelogram guide consisting of two rods 41. This guide is moved by a rod 42, in turn activated by the electromagnet in such a manner that the retaining bolt 40 swivels out of roll receptacle 39 into a position indicated by the broken line detail in the drawing. Two guide rails 43, located laterally to the parallelogram guide control the motion of the parallelogram, at the same time acting as limiting stops at the two extreme positions of retaining bolt 40.

Figure 5:
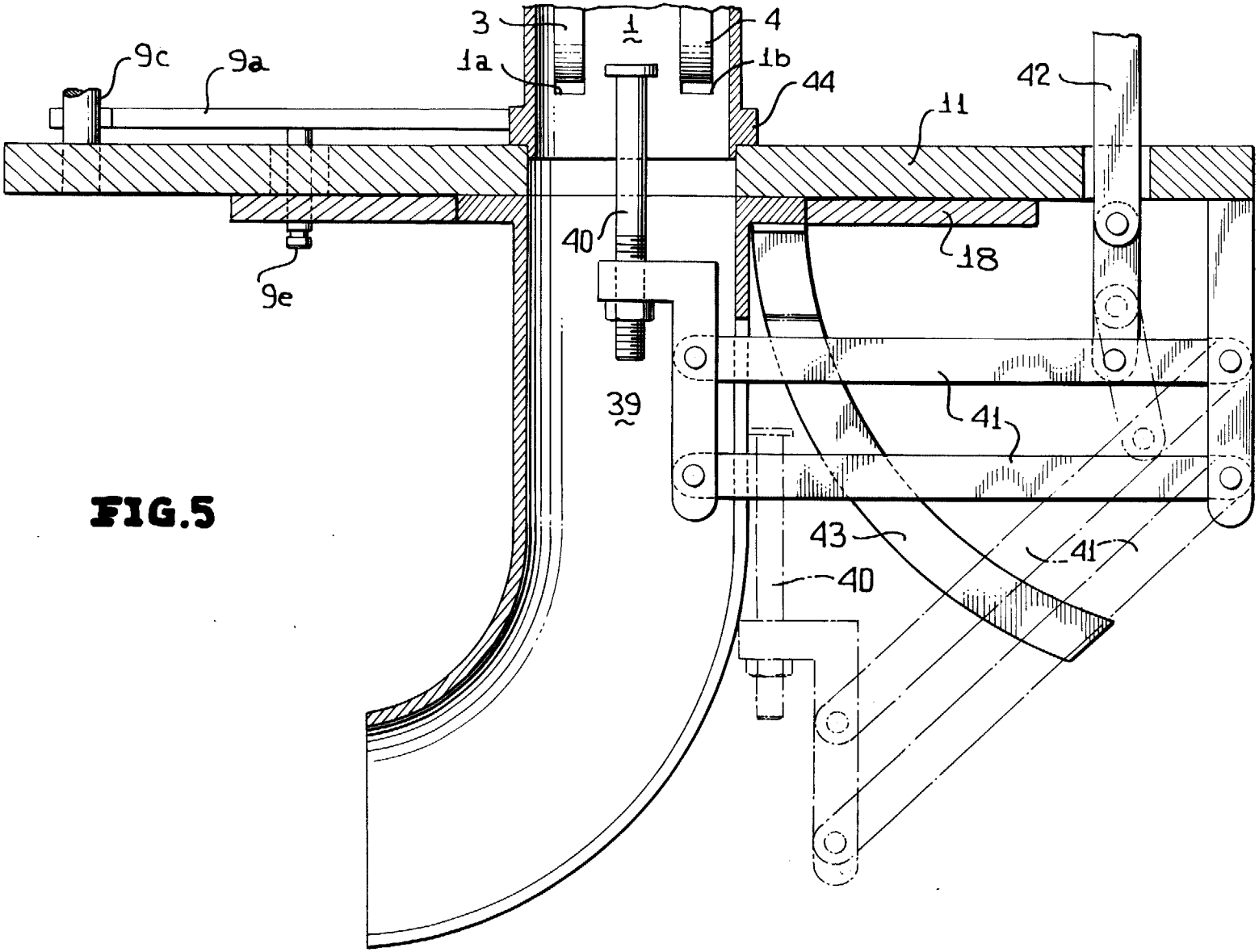
FIG. 5 is an axial section, on an enlarged scale, of the output ramp for finished rolls.

FIG. 5 shows the longitudinal slots in housing 1, marked for reference 1a and 1b. The third slot is in front of the plane of this drawing and cannot be seen. The slots are shown occupied by guide rollers 3 and 4, with only their lower ends being visible in FIG. 5.

At the lower end of housing 1, where it is set into base plate 11, there is a radially protruding sleeve 44 which serves as an inward stop to the swivel motion of guide rollers 2, 3, 4, when the levers 8a, 9a, 10a, touch the sleeve. The outer diameter of sleeve 44 corresponds to the diameter of the processed coins, whereby the rollers can enter into the housing 1 only far enough to let the coins fed into the housing from the top drop down onto stop bolt 40 and be stacked there. It is practical that sleeve 44 be so dimensioned that the diameter of the space between guide rollers 2, 3, 4 is somewhat smaller than that of the entering coins. The entering coins will press the guide rollers radially outwardly, producing a firm pressure between the rollers and the coins. The position of sleeve 44 on the housing offers the advantage that, upon a change-over from one type of coin to another necessitating a change of housings, the stops limiting the inward penetration of the rollers are automatically corrected.

Figure 6:
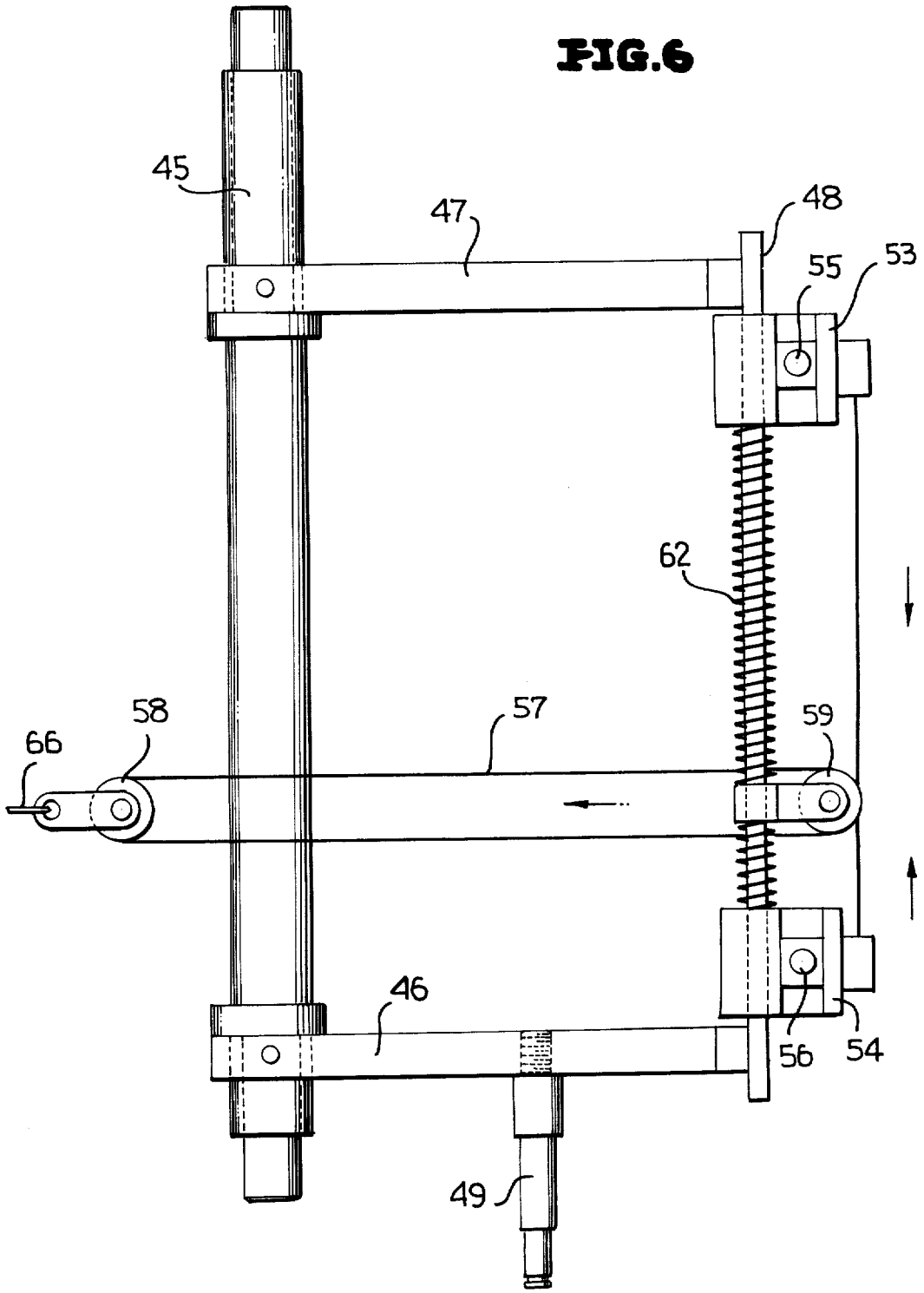
FIG. 6 is an enlarged side view of the edging device.
Figure 7:
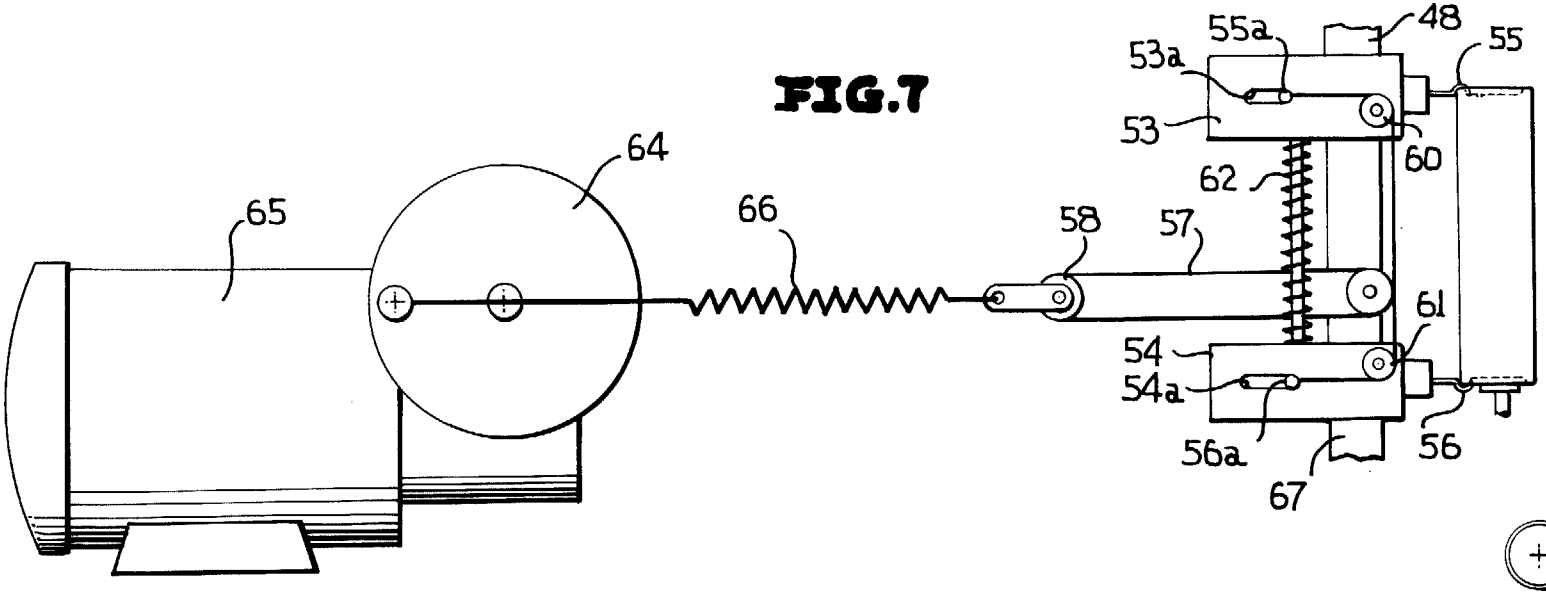
FIG. 7 is a view of the edging device including its eccentric drive.

FIGS. 6 and 7 show the structure of the edging mechanism. It consists of an axle 45, mounted between base plate 11 and cover plate 12. To this axle are connected two parallel turntable swivel levers 46, 47, spaced one above the other. The free ends of these levers are both attached to rail 48 (also shown in FIG. 2). The lower swivel lever 46 is provided with a stud 49 which extends through slot 50 in the base plate 11 into a curved guide slot 51 (FIG. 4) in guide plate 18. The guide slot 51 has a shape similar to that of curves 19, 20, 21, but is set at an angle to the radial direction. At the lower end of stud 49 a tension spring 52 pulls the swivel lever 46 radially inwardly.

On rail 48 two vertically movable slides 53, 54 are mounted, each having an edging hook 55, 56 which can move horizontally (see also FIG. 7). Both hooks are equipped with a peg 55a, 56a which slides inside a horizontally placed guide 53a, 54a that controls the horizontal motion of the hooks. The edging hooks are activated by a pull cord 57 wound around a tension pulley 58. The cord is passed over pulley 59 attached to rail 48 and also over a deflecting pulley 60, coordinated also with slide 53; and also over deflecting pulley 61 coordinated with slide 54; the ends of the cord are fixed to pegs 55a and 56a.

Furthermore, each of the two slides holds a spring (not shown) which pushes the edging hooks (FIG. 7) toward the left, away from the housing. The sum of the forces of these two springs is less than that of the compression spring 62 urging separation of the two slides. As a result, a pull on tension pulley 58 toward the left side will first move the edging hooks 55, 56 into the extended position shown in FIG. 7. When this position has been reached, pegs 55a and 56a block any further motion of the edging hooks. Instead, the pull cord now moves slides 53, 54 toward one another, its force overcoming that of spring 62, and the edging hooks are brought axially into engagement with the two at both ends as indicated schematically in FIG. 7. wound The pulling force on tension roller 58 is supplied by a rotating crank disk 64 connected to electric motor 56, equipped with an overload device. To cushion vibration, a coil spring 66 connects tension pulley 58 with crank disk 64.

The lower end of rail 48 in FIG. 7 shows stop 67 which engages sleeve 44 on housing 1 in such a way that the range of the swivel motion around axle 45 corresponds to the diameter of the coins.

Figure 8:
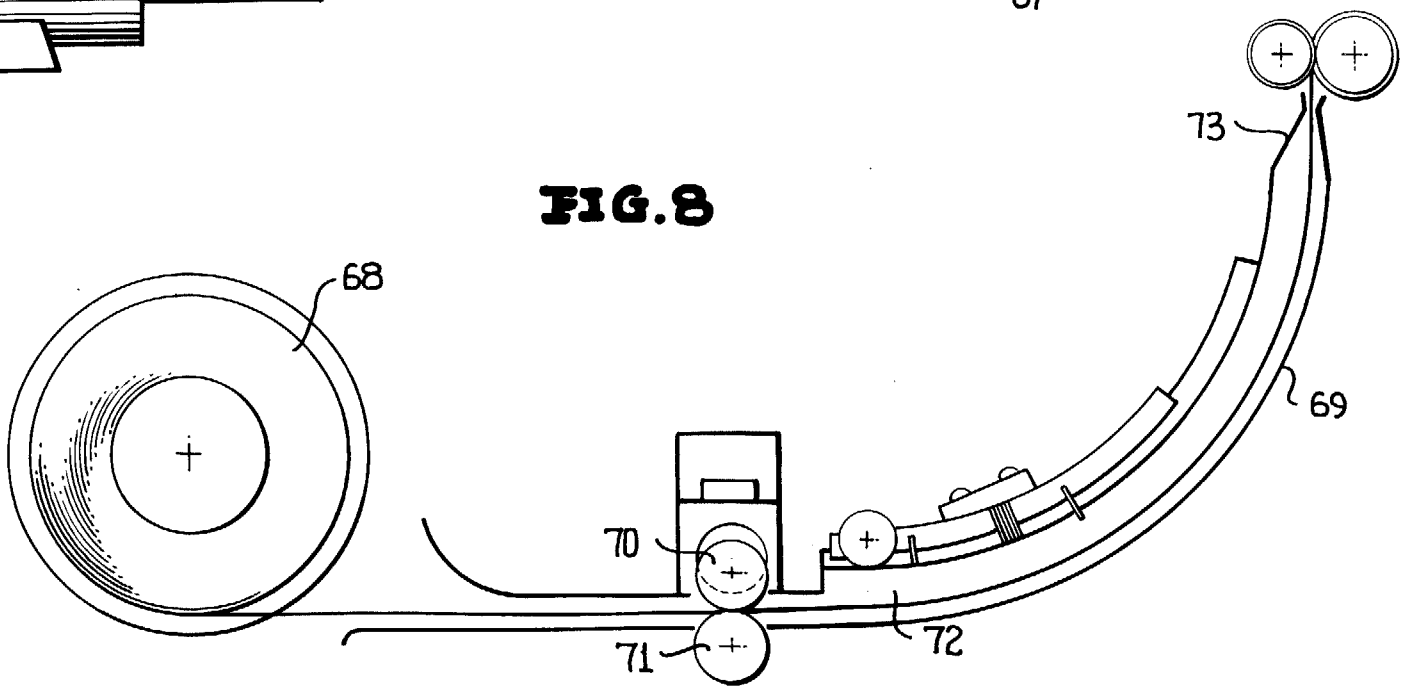
FIG. 8 is a top view of the paper feeding device.

FIG. 8 shows the paper feeding device used for wrapping the stacks of coins. For the sake of clarity this unit has not been shown on the figures discussed so far. It consists essentially of a paper roll 68, a guide track 69 equipped with two propulsion rollers 70, 71, and a knife 72 which can protrude into the track of the paper. The track 69 brings the paper approximately tangentially to housing 1 and directs it through a longitudinal slot into its interior. To firmly insert the paper into the housing, a lead spring 73 is installed at the end of track 69.

The operation of the wrapping device is as follows:

A housing 1 is selected matching the size of coins to be processed and inserted from above into the central opening 12*a* in cover plate 12, securely engaging its lower end with base plate 11. A keying device (not shown in the drawings) assures that the housing is inserted with the longitudinal slots in a correct position relative to the guide rollers, and secured against play. During the insertion of housing 1, the guide plate 18 must be turned to a position in which the guide rollers are swung outwardly. This can be achieved either by hand adjustment, turning lever 28, or electrically by means of electromagnet 29. After the housing has been inserted, guide plate 18 is released and the guide rollers will move radially inwardly, activated by springs 25, 26, 27 until parts of their circumference 2*a*, 3*a*, 4*a* intrude through the longitudinal slots 1*a*, 1*b*, 1*c* into the interior of the housing. The extent of this inward motion is controlled by swivel levers 8*a*, 9*a*, 10*a* touching sleeve 44 on the housing. Subsequently, the coins to be packaged are, usually automatically, fed into the upper end of the housing which has been widened to form a funnel. Guide rollers 2 and 3 are kept rotating by motor 13 so that the coins are stacked rapidly and securely on stop bolt 40. When the predetermined number of coins has been reached, and on an impulse sent by an appropriate counter, the propulsion rollers 70, 71 begin pulling paper off roll 68, and inserting it along track 69 and guide spring 73, projecting it tangentially into the inside of the housing 1. The paper may be inserted into the housing either through one of the slots provided for the guide rollers, or through a separate slot. In any event, the direction of the paper feed must correspond to the rotational spin of the stack, so that the paper can be taken up by the rotating coin stack and the guide rollers, and thereby wrapped around the stack. By essentially conventional techniques, i.e., a timed interruption of the paper flow, the advance of the paper strip is stopped as soon as sufficient paper has been paid out, whereupon the paper, subjected to a sudden pull, is torn off along knife 72.

Through a conventional automatic release mechanism motor 65 then starts pulling on tension disk 58 by way of eccentric disk 64, causing first the two edging hooks 55, 56 to move radially into the interior of the housing, until pegs 55*a* and 65*a* reach the ends of slots 53*a*, 54*a*. Further pull on tension disk 58 causes the two edging hooks to move toward each other to fold the loose paper edge over in the conventional manner. Toward the end of the edging phase inertia increases sharply, so that a friction clutch (not shown), between crank disk 64 and the motor 65, can slip and cut off the motor, releasing the edging hooks, so that they return to their basic position through spring action.

Subsequently, electromagnet 29 is activated by conventional automatic release mechanism, whereby the guide rollers swing radially outwardly and release the completed roll. Simultaneously, stop bolt 40 swings downwardly, and the roll slides out through the exit ramp.

By a time relay, guide rollers 2, 3, 4, together with stop bolt 40 are caused to swing back inwardly again, the feeding-in of coinage is resumed and the operation repeated.

I claim:

1. A device for stacking and packaging generally rigid disc-shaped elements comprising a generally vertical cylindrical tubular housing having an interior of a generally circular cross-section for accommodating disc-shaped elements of a predetermined diameter, means for at least temporarily supporting a stack of the disc-shaped elements in said housing, at least one longitudinal slot in said housing, at least one guide roller mounted for rotation about a vertical axis, means mounting said roller for generally transverse movement relative to said longitudinal slot whereby a peripheral exterior surface of said roller will project into said housing through said longitudinal slot, means for feeding a web of paper generally tangentially into said housing into exterior adjacent relationship to said stacked disc-shaped elements, means for rotating said guide roller to thereby rotate said stack of disc-shaped elements and wrap the web of paper therearound, stop means immovably fixedly carried by said housing for limiting movement of said guide roller into said housing to rotate disc-shaped elements only of said predetermined diameter upon the rotation of said guide roller, said housing and said stop means carried thereby being readily removable from its operative association with said guide roller whereby another housing with different stop means immovably fixedly carried thereby can be substituted for said first-mentioned housing and stop means to wrap disc-shaped elements of a diameter differing from said predetermined diameter.

2. The device as defined in claim 1 wherein said roller mounting means includes an arm carrying said roller, means mounting said arm for pivotal movement toward and away from said housing, and said arm being aligned to contact said stop means upon pivotal movement of said arm in a direction toward said housing thereby limiting the guide roller movement into said housing.

3. The device as defined in claim 1 including folding means for folding over the ends of the wrapped paper projecting above and below the stacked coins, said folding means being upper and lower folder hooks, means for displacing said folder hooks radially and axially relative to said housing, and means for adjusting at least one of axial and radial displacing means.

4. The device as defined in claim 1 including folding means for folding over the ends of the wrapped paper projecting above and below the stacked coins, said folding means being upper and lower folder hooks, means for displacing said folder hooks radially and axially relative to said housing, and means for adjusting both said axial and radial displacing means.

5. The device as defined in claim 1 including a frame, said roller mounting means includes an arm carrying said roller, means mounting said arm upon said frame for pivotal movement toward and away from said housing, a follower carried by said arm, and cam means for contacting and moving said follower to pivot said arm relative to said housing.

6. The device as defined in claim 2 including folding means for folding over the ends of the wrapped paper projection above and below the stacked coins, said folding means being upper and lower folder hooks, means for displacing said folder hooks radially and axially relative to said housing, and means for adjusting at least one of axial and radial displacing means.

7. The device as defined in claim 2 including folding means for folding over the ends of the wrapped paper projecting above and below the stacked coins, said folding means being upper and lower folder hooks, vertically disposed rail means for guiding therealong said upper and lower folder hooks, and means for moving said upper and lower folder hooks along said rail means.

8. The device as defined in claim 7 wherein said folder hooks are each carried by a slide carried by said rail means, said rail means being disposed generally vertically, upper and lower ends of said rail means being connected to respective upper and lower arms, and means for pivotally connecting said upper and lower arms to a frame of said device.

9. The device as defined in claim 8 characterized by the fact that said folder hooks are each held by a spring in a retracted position; a compression spring between the two slides, the force of which exceeds the force of the springs acting upon the folder hooks, and a pull cord attached at each end to the folder hooks, and activating them, so that they approach the ends of the wrapped paper, said cord extending horizontally away from said folder hooks and vertically into a space between said folder hooks and being further entrained over pulleys including immovable pulley assembly.

10. The device as defined in claim 9 wherein said housing including stop means for limiting movement of said slides toward each other.

11. A method of stacking and packaging generally rigid disc-shaped elements of varying diameter comprising the steps of stacking, a first group of disc-shaped elements of a first diameter in a first housing having a first longitudinal slot and a first stop immovably fixedly carried thereby, feeding a web of paper generally tangentially into the first housing, moving a rotating roller having a vertical axis transversely of the first housing in the longitudinal slot toward the first group of disc-shaped elements, limiting the last-mentioned movement by the first stop, rotating the guide roller to rotate the first group of stacked disc-shaped elements and wrap the web of paper therearound, substituting a second housing having a second longitudinal slot and a second immovably fixedly carried stop differing from said first stop for said first housing, stacking in said second housing a second group of disc-shaped elements of a second diameter differing from said first diameter, feeding a web of paper generally tangentially into the second housing, moving said rotating roller transversely of the second housing in the longitudinal slot thereof toward the second group of disc-shaped elements, and limiting the last-mentioned movement by the second stop.

* * * * *